US005937751A

United States Patent [19]

Newman, Jr.

[11] Patent Number: 5,937,751

[45] Date of Patent: Aug. 17, 1999

[54] RETENSIONABLE SCREEN FRAME AND STRETCHERS

[76] Inventor: Eugene F. Newman, Jr., 7946 Stonehurst Dr., Dublin, Ohio 43016

[21] Appl. No.: 08/862,846

[22] Filed: May 23, 1997

Related U.S. Application Data

[60] Provisional application No. 60/018,324, May 24, 1996.

[51] Int. Cl.[6] ..... B41F 15/34

[52] U.S. Cl. ..... 101/127.1; 38/102.4; 160/374.1

[58] Field of Search ..... 101/127.1, 128, 101/128.1; 38/102.21, 102.91, 102.4, 102, 102.1, 102.5; 160/374, 374.1, 372, 375, 378, 381

[56] References Cited

U.S. PATENT DOCUMENTS

| | | | |
|---|---|---|---|
| 232,467 | 9/1880 | Demorest | 160/374 |
| 414,184 | 11/1889 | Bentley | 38/102.21 |
| 1,365,584 | 1/1921 | Constable | 38/102 |
| 3,482,343 | 12/1969 | Hamu | 101/127.1 |
| 3,507,062 | 4/1970 | Moyer | 38/102.91 |
| 3,553,862 | 1/1971 | Hamu | 101/127.1 |
| 3,601,912 | 8/1971 | Dubbs | 38/102.91 |
| 4,373,441 | 2/1983 | Messerschmitt | 101/127.1 |
| 4,525,909 | 7/1985 | Newman | 38/102.91 |
| 4,660,308 | 4/1987 | Dang et al. | 38/102.4 |
| 5,163,367 | 11/1992 | Newman | 101/127.1 |
| 5,274,934 | 1/1994 | Newman, Jr. | 101/128.1 |
| 5,443,003 | 8/1995 | Larson | 101/127 |

OTHER PUBLICATIONS

Fax Jan. 31, 1998 LR–Frame Assembly Stretch Devices, Inc.

*Primary Examiner*—Edgar Burr
*Assistant Examiner*—Amanda B. Sandusky

[57] ABSTRACT

A screen printing frame and bordered fabric stretching devices for quickly stretching a screen and for retensioning a screen. The apparatus includes stretching devices for adjustment the print registration of a stencil on the screen. The bordered fabric can be quickly released from the frame.

7 Claims, 5 Drawing Sheets

RETENSIONABLE SCREEN FRAME AND STRETCHERS

CROSS REFERENCE TO RELATED APPLICATION

This application is related to U.S. Provisional patent application Ser. No. 60/018,324 filed May 24, 1996.

BACKGROUND OF THE INVENTION

1. Field of the Invention

This invention relates in general to screen printing frames and stretchers and in particular to screen printing frames and stretchers for use with bordered fabric.

2. Prior Art

In screen printing it is desirable to have screens that can be quickly and easily stretched. Once a screen has been initially stretched, it is desirable to be able to quickly increase the tension of the screen as it inevitably loses tension with time and to adjust an imaged screen so that coordinates of the imaged screen can be moved in relation to the coordinates of a substrate on a printing press.

The earliest frames were simple wooden or metal rigid frames on which the fabric was stapled or glued as the fabric was stretched by hand or by mechanical means. Later, frames evolved wherein the fabric could be fastened to the frame sides and by rolling, telescoping, or expanding the sides of the frame, the fabric could be stretched. The stretching process became internal to the frame rather than external to the frame. Notable examples of self-tensioning screen frames of this type include U.S. Pat. No. 3,482,343 by Hamu, U.S. Pat. No. 3,914,887 by Don Newman, and U.S. Pat. No. 5,113,611 by Gene Rosson. These screen frames, in eliminating the use of external stretcher devices, do not have all the advantages offered by some external stretching systems. For example, pneumatic clamp and stretch systems have been developed which can very accurately distribute uniform tension over the entire area of a screen. Self tensioning screens, on the other hand, generally have greater tension in the corner areas. Hamu's draw-bar frame is able to overcome this problem but it is a difficult and labor intensive frame to work with. Also, the Hamu frame, unless made extremely bulky and oversized, has a limited stretch distance that is inadequate for many highly stretchable fabrics.

Bordered fabric and frames were introduced in U.S. Pat. No. 3,991,677 by V. H. Barnes, U.S. Pat. No. 3,211,089 by Edgar Messerschmidt, U.S. Pat. No. 3,416,445 by T. H. Krueger, U.S. Pat. No. 2,903,967 by H. S. Levin, U.S. Pat. No. 3,078,793 by D. Jaffa, U.S. Pat. No. 5,274,934 by Eugene Newman, and U.S. Pat. No. 5,390,596 by Gregory Farr. Eugene Newman discusses using an external stretching device to attach bordered fabric to a frame. This is the only reference in the prior art to an external stretcher device used to stretch bordered fabric onto a frame. All other prior art refers to self-tensioning frames. In U.S. Pat. No. 5,522,314, Eugene Newman further teaches a method of constructing border strips onto fabric so as to embody the bordered fabric, when stretched, with an accurate and uniform tension level throughout the screen.

In practice, the use of an external stretcher device to stretch and mount a piece of bordered fabric to a rigid frame as taught by Eugene Newman in U.S. Pat. No. 5,274,934 is a quick and easy way to stretch a screen initially. However, re-tensioning continues to rely upon a stretcher device that must be attached directly to the border strips. Adapters, used as spacers, are inserted between the outwardly pulled border strips and the outside walls of the frame, filling in the gaps left by the outward pulling of the border strips away from the frame. These adapters are awkward to work with and limit re-tensioning to discreet increments rather than a continuous range. Also, by teaching that the external stretcher device always attaches to the border strips, other means of re-tensioning the screen are not explored.

Whatever the precise merits, features, and advantages of the above cited references, none of them achieves or fulfills the purposes of the present invention.

SUMMARY OF THE INVENTION

The present invention comprises a frame with sides suitable for mounting bordered fabric wherein the bordered fabric is initially stretched by an external stretching device which attaches to and directly pulls the borders of said bordered fabric so as to stretch and mount said bordered fabric on said frame. The present invention also comprises secondary stretching devices that engage and force the sides, or portions of the sides, of the frame, with the mounted bordered fabric, to move to new locking positions on the frame over a continuous range thereby increasing or decreasing the stretching of the bordered fabric.

An object of the present invention is to increase the speed and ease in which bordered fabric can be stretched on a frame and to increase the speed and ease in which an imaged screen stencil, or portions of an imaged screen stencil, can be stretched or relaxed on a frame so as to better register images of the screen stencil with print substrates, particularly when said screen is positioned on a printing press.

The external stretching device for initially stretching the bordered fabric, in the preferred embodiment, comprises a roller to which is attached a sheet, or flap, with fasteners that attach to border strips of bordered fabric. By lowering the roller below the level of the frame, manually mounting a first border strip to a side of the frame and then attaching said sheet of the stretching device to the border strip on the opposite side of the screen and rotating the roller so as to pull in and wrap the sheet on the roller, the attached bordered fabric is pulled outwardly and downwardly over the frame and the border strip then cups, or hooks, into place on the frame thus mounting the second side of the screen. By following these same steps for the remaining sides of the bordered fabric, the bordered fabric is mounted on the frame on all four sides.

To release the bordered fabric from the frame, the sheet of the stretching device is attached to a border strip. By elevating the roller above the frame and initially rotating the roller so as to again wrap the sheet on the roller, the border is pulled up and away from the frame. Reversing the rotation of the roller relaxes the fabric so that the border strip can be unfastened from the stretching device. Next, the sheet of the stretching device is attached to either border strip along the other axis of the screen and the above procedure is repeated. Lastly, the two remaining border strips can then be easily dismounted from the frame by hand.

Another equally effective stretcher system is the simple lever. A lever to which is attached an elongated fastener that fastens to fabric border strips is functionally identical to roller systems.

The frame of the present invention comprises sliding sides, or side bars, which comprise fastening features, such as elongated flanges facing away from the frame. These flanges are shaped so as to fit into fastening features, such as elongated recesses on fabric border strips. The side bars are able to slide outwardly along leg members that form the comers of the frame. The frame may further comprise support beams that are parallel to the side bars of the frame and connect the comers of the frame. These support beams, although not absolutely essential, do provide additional support and rigidity to the frame and allow more numerous ways to re-tension the screen with secondary stretching devices.

To provide additional stretching of the screen once it has been initially mounted on the frame, secondary stretching devices are used. In the preferred embodiment, these are comprised of very simple external stretching devices comprising threaded cylindrical rods, with a locking head at one end and a handle, or a wrench lug, at the other end, engaging a block with a threaded hole and used as a simple device for applying power. The threaded rod, when rotated, applies power to move the locking head and the threaded block toward or away from each other. The locking head or the threaded block is designed to lock onto the frame side bar while the other is attached to either the corner leg or the support beam. With the stretching device so attached, the frame side bar can be forced to a more outward position on the frame by rotating the threaded rod, thereby increasing tension in the screen, or it can be forced inwardly, thereby relieving tension in the screen. With the frame side bar loosened on the corner legs so it is free to slide outwardly, the secondary stretching devices usually work in pairs to simultaneously pull both ends of the frame side bar outwardly. Inserts fitted into the gap between the support beam and the frame side bar can be used to assure parallelism and a controlled stretch distance of the screen.

If the frame side bars are locked down on the corner legs so that they can not slide and if the secondary stretcher devices are attached to the support beam and the side bar, especially toward the center of the frame side, the frame side bar may be made to bow outwardly or inwardly. Combinations of secondary stretching devices can be made to bow the side bars in various arcs which may provide for better stencil registration, particularly if there are substrate distortions on the press.

The secondary stretching devices, though not preferred, may also comprise internal parts of the screen frame. For example, they could comprise a simple threaded bolt that rotates within a threaded bore of an internal part of the frame, such as the support beam or the frame side bar. By rotating the threaded rod through the support beam toward the frame side or through the frame side toward the support beam, the threaded rod forces the side bar to move outwardly.

DETAILED DESCRIPTION

Figure 1:
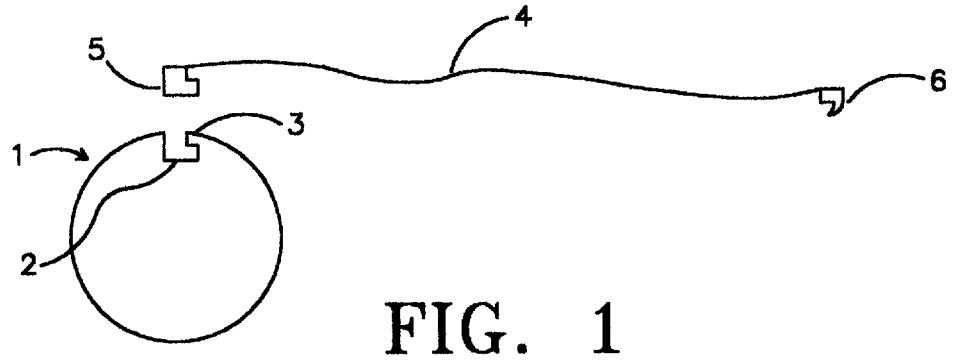
FIG. 1 is a side view of one embodiment of the roller and flexible sheet of the initial external stretching device of the present invention.
Figure 2:
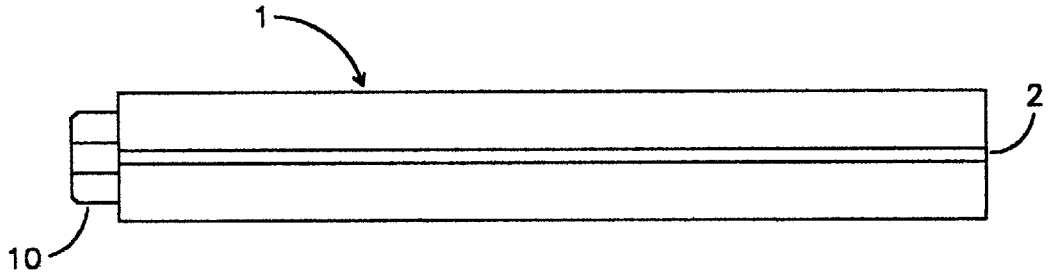
FIG. 2 is a top view of one embodiment of the roller of the initial external stretcher device of the present invention.
Figure 3:
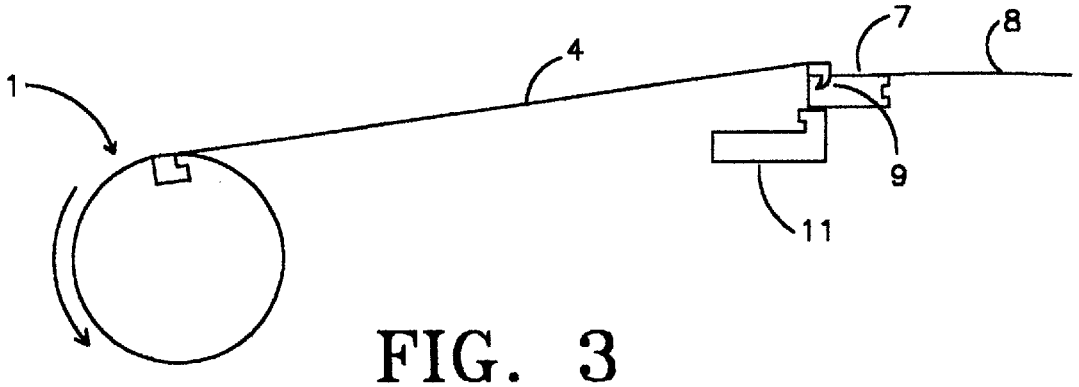
FIG. 3 is a side view of one embodiment of the initial external stretcher device of the present invention.
Figure 4:
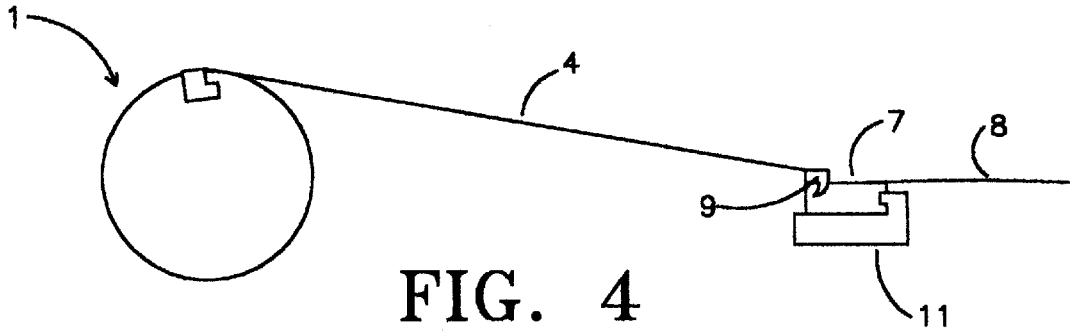
FIG. 4 is another side view of one embodiment of the initial external stretcher device of the present invention.

The external stretching device for initially stretching the bordered fabric comprises at least one roller 1 as in FIGS. 1,2,3,and 4 that is attached to and supported by a housing unit (not illustrated) in such a way that said roller 1 is parallel to one side of a screen frame, which is held in place by a housing apparatus (not illustrated). Said roller 1 comprises an elongated locking groove 2 having an elongated flange 3 extending along the length of said locking groove 2 on the wall of said locking groove 2 that is nearest the frame in FIG. 1. A selectively sized elongated flexible sheet, or flap, 4 comprising an elongated locking key 5 on one edge shaped as an elongated lip or hook-like structure can be snugly inserted into said locking groove 2 attached to roller 1. Said flexible sheet 4 need not be as long as said roller 1, but said flexible sheet must be aligned with frame side-bar 11 illustrated in FIGS. 3 and 4. These frame side-bars are designed to hold border strips 7 of a fabric piece 8 so as to lock the bordered fabric on a frame. When said flexible sheet 1 is properly aligned with said frame, roller 1 should be at or below the level of side-bar 11, as is shown in FIG. 3. The flexible sheet comprises fastening features, such as teeth 9, designed to insert into holes on border strips 7, that firmly grip the border strip 7 to sheet 4. With a border strip so gripped and with the bordered fabric attached to the frame by hand on the opposite side of the frame, rotating roller 1 begins to wrap sheet 4 around roller 1 thereby pulling the bordered fabric outwardly over and down onto side-bar 11, where it fits into place on the fastening features of the side-bar. The final fitting into place of the border strip may require a slight reverse rotation of roller 1 to allow border strip 7 to be pulled back by the tensioned fabric onto the fastening features of side-bar 11. This process is based on the fabric being stretched tightly so that it is under tension. Repeating the above steps along the other axis of the screen will complete the stretching of the screen.

To release the screen from the frame, roller 1 is elevated above side-bar 11 and sheet 4 is attached to border strip 7. By rotating roller I so as to wrap sheet 4 on the roller, the bordered fabric is pulled up and away from the frame. Reversing the rotation so as to relax the fabric will allow the sheet to be removed from border strip 7. Repeating these steps along the other axis will release another border strip from the frame and the fabric will now become completely relaxed so that the remaining two border strips can be removed by hand from the frame.

A wrench (not illustrated) can be attached to nut 10 in FIG. 2 at the end of roller 1 for rotating the roller.

Figure 5:
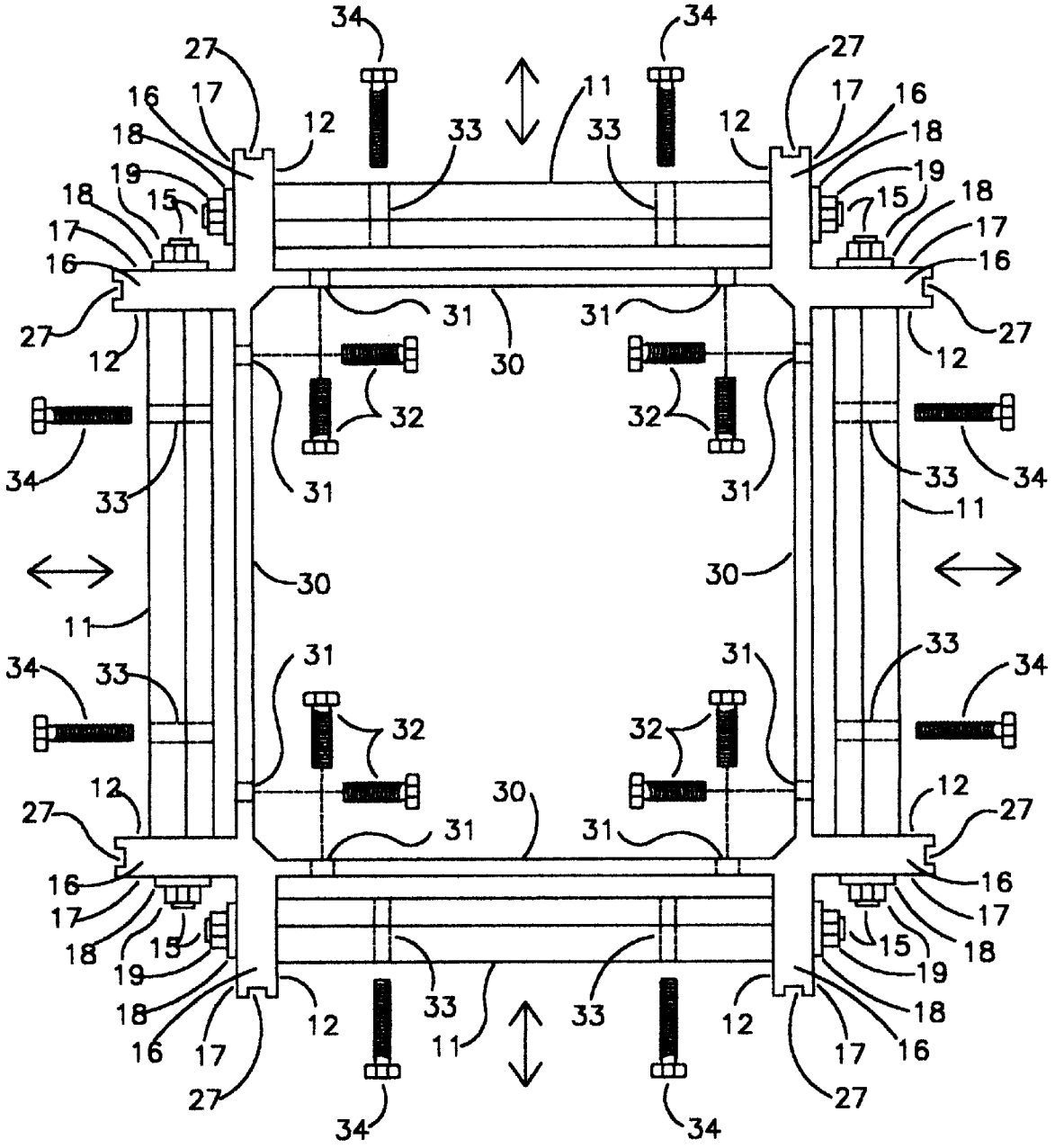
FIG. 5 is a top view of one embodiment of the frame of the present invention.
Figure 7:
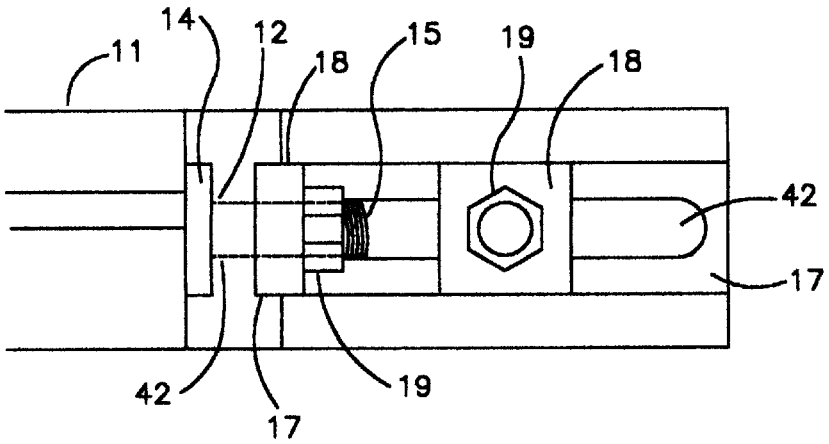
FIG. 7 is a side view of one embodiment of the frame comer of the present invention.
Figure 8:
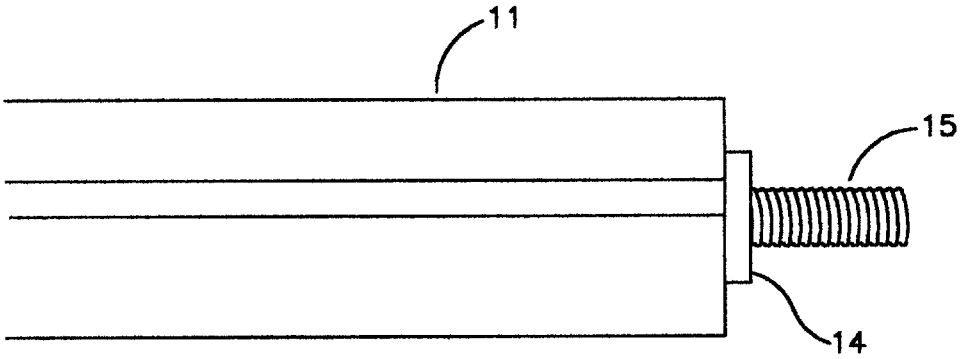
FIG. 8 is a side view of one embodiment of the frame side-bar of the present invention.
Figure 9:
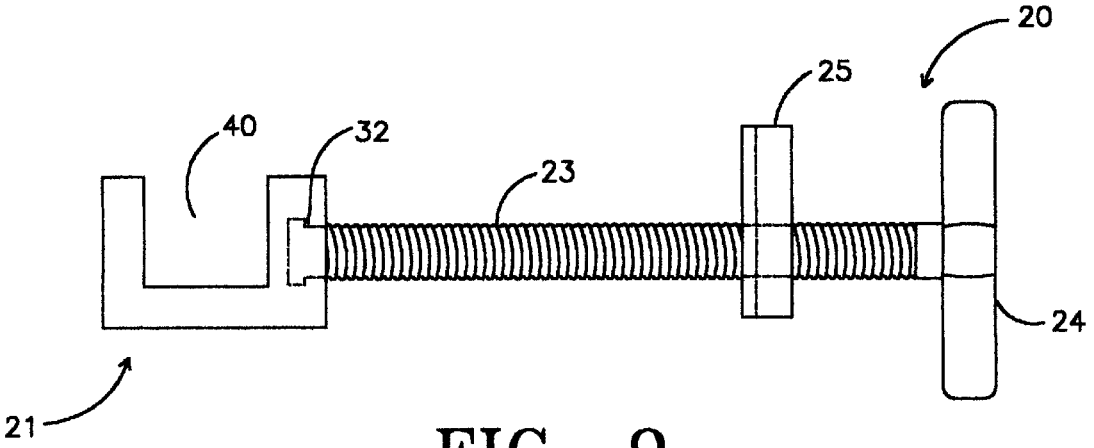
FIG. 9 is a side view of one embodiment of a secondary stretching device of the present invention.
Figure 10:
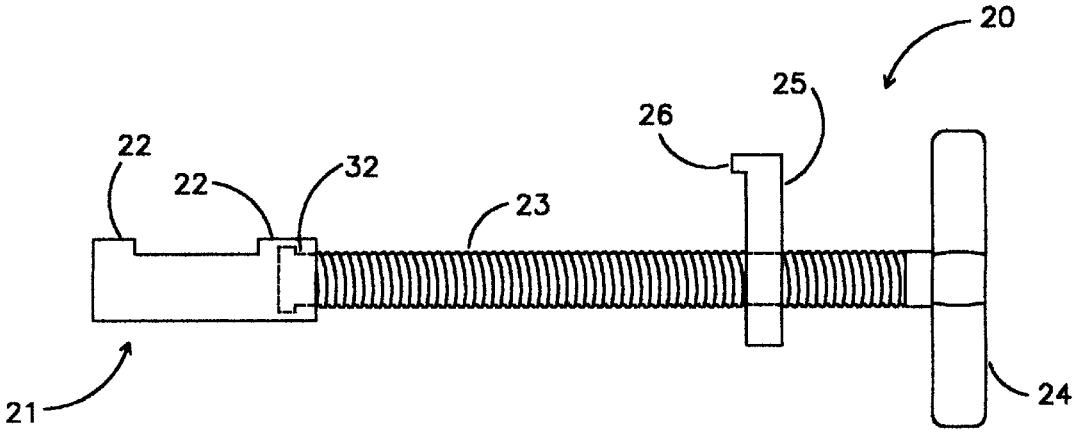
FIG. 10 is a top view of one embodiment of a secondary stretching device of the present invention.
Figure 11:
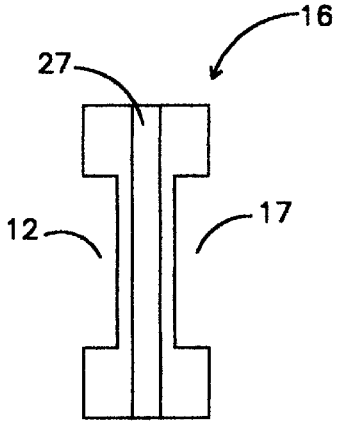
FIG. 11 is a side view of one embodiment of a corner leg of the present invention.

The frame of the present invention, in its preferred embodiment, comprises side-bars 11 that slide along recessed grooves 12 of FIGS. 5, 7, and 11. Said grooves 12 are on the inside face of the comer legs 16 of the frame. Side-bars 11 have protrusions 14 that fit within grooves 12 as in FIGS. 7 and 8. Said side-bars 11 further comprise threaded rods 15 shown in FIGS. 5, 7 and 8 that fit through elongated slots 42 in FIG. 7 of corner legs 16. Recessed grooves 17 shown in FIGS. 7 and 11 on the outside face of corner legs 16 serve as a track for blocks 18 to travel. When nuts 19 shown in FIGS. 5 and 7 are tightened, they lock down said blocks 18 and said side-bars 11. By loosening nuts 19, blocks 18 and side-bars 11 are free to slide along legs 16 within grooves 17 and 12, respectively. External stretching device 20 of FIGS. 9 and 10 comprises a locking head 21 shaped with a recess 40 so as to fit snugly onto block 18. External stretching device 20 also comprises prongs 22 that fit into recessed grooves 17. This combination of features in locking head 21 holds block 18 within head 21. External stretching device 20 further comprises a threaded rod 23 that is attached to head 21 but is free to rotate within housing 32 of FIGS. 9 and 10. At the other end of threaded rod 23 is attached a handle 24 for rotating said threaded rod. External stretching device 20 further comprises a block 25 with a threaded bore through which passes said threaded rod so that when handle 24 rotates said threaded rod, block 25 moves along said threaded rod. Block 25 further comprises a cupped flange 26 that fits into a recess 27 on legs 16 so as to properly position and secure external stretching device 20 so that by turning handle 24 when locking head 21 is holding block 18 within recess 40, said external stretching device 20 moves block 18 along recessed groove 17. This movement causes side-bar 11 to move along recessed groove 12. By tightening nut 19 once side-bar 11 is in a desireable position, side-bar 11 is secured in that position. It is generally desireable that this positioning be done simultaneously with two external stretching devices 20 at each end of any given side-bar so as to position the side-bar generally parallel to the opposite side of the frame.

Figure 6:
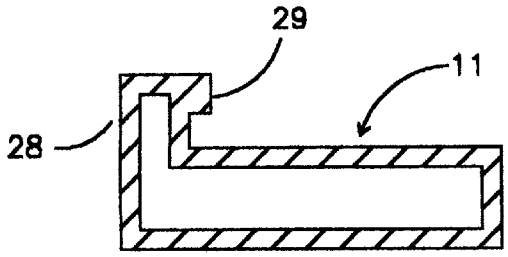
FIG. 6 is a side view of one embodiment of the frame side-bar of the present invention.

Side bars 11 may further comprise a cross sectional shape comprising two legs at a right angle to each other as in FIG. 6 with one leg 28 in a vertical position. Said vertical leg may comprise a flange 29 facing toward the outside of the frame. Said flange serves to fit into a recess of a border strip attached to a piece of fabric. When said border strips on all four sides of a piece of bordered fabric are stretched over said flange 29 on all four side-bars 11 of the frame in such a manner as to mount said border strips on said side-bars, the screen is stretched. By then moving side-bars 11 to more outward positions on legs 16, said fabric may be stretched more tightly on the frame, making a more ideal screen for screen printing.

Optionally, the frame may further comprise support beams 30 in FIG. 5 spanning between corner leg members 16 to provide additional support to the frame unit, which is also supported by side-bars 11. Said support beams help to keep the frame perfectly flat and they work with additional external stretching devices.

Figure 12:
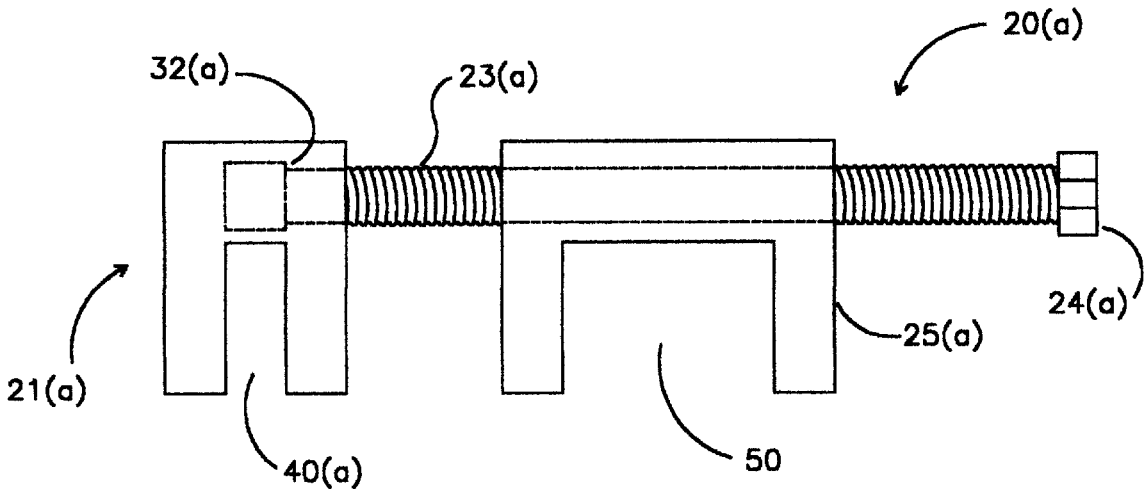
FIG. 12 is a side view of an additional secondary stretching device of the present invention.

In FIG. 12 is illustrated the preferred embodiment of an additional external stretching device 20(a).This device comprises a locking head 21(*a*) shaped with a recess 40(*a*) so as to fit and hold snugly onto support beam 30 of FIG. 5. External stretching device 20(*a*) further comprises a threaded rod 23(*a*) that is secured to head 21(*a*) but is free to rotate within housing 32(*a*) of FIG. 12. At the other end of threaded rod 23(*a*) is attached a lug nut 24(*a*) for rotating said rod. External stretching device 20(*a*) further comprises a block 25(*a*) with a threaded bore through which passes said threaded rod 23(*a*) so that when said handle 24(*a*) rotates said rod, block 25(*a*) moves along said rod. Block 25(*a*) further comprises a recess 50 that fits onto frame side-bar 11 of FIG. 5. When block 25(*a*) is thus attached to side-bar 11, rotation of rod 23 (*a*) causes side-bar 11 to move with the movement of block 25(*a*).

With nuts 19 of FIGS. 5 and 7 loosened, external stretching devices 20(*a*) generally work in pairs with one external stretching device 20(*a*) at each end of side-bar 11 so as to maintain parallelism. Inserts of a measured width may be placed between side-bar 11 and support beam 30 to assure parallelism.

Support beams 30 may further comprise threaded bores 31 through which threaded bolts 32 may be screwed toward side-bars 11 so as to force side-bars 11 to more outward positions. In a similar way, side-bars 11 may comprise threaded bores 33 through which threaded bolts 34 may be screwed toward support beams 30 so as to force side bars 11 to more outward positions.

With nuts 19 of FIGS. 5 and 7 tightened, external stretching devices 20(*a*) may be used to bow side-bars 11 outwardly or inwardly by forcing side-bars 11 away from or toward support beams 30 at the point where the secondary stretching device is attached.

The foregoing description of the preferred embodiment of the invention has been presented for the purposes of illustration and description. It is not intended to be exhaustive or to limit the invention to the precise form disclosed. Many modifications and variations are possible in the light of the above teaching. It is intended that the scope of the invention be limited not by this detailed description, but rather by the claims appended hereto.

What is claimed is:

1. An apparatus for tensioning screen fabric having attached border strips comprising a frame formed by corner leg members having outwardly projecting legs at right angles and outwardly and inwardly moveable side bars releaseably mounted and locked onto said comer leg members, said side bars having means for fastening border strips of screen fabric.

2. The apparatus of claim 1 further comprising support beams generally parallel to said side bars and attaching to said corner leg members.

3. The apparatus of claim 1 further comprising a stretcher device having means to grip and pull successive edges of said fabric outwardly from said frame after at least one edge of said fabric is attached to said side bars, said stretcher device and said frame having cooperative means of fastening said stretched fabric borders onto said side bars.

4. The apparatus of claim 1 further comprising secondary stretching devices having a means of locking onto said side bars and said corner leg members and having a means of applying power to move said side to more outward and inward positions along said corner leg members after said side bars have been unlocked from said corner leg members.

5. The apparatus of claim 2 further comprising secondary stretching devices having a means of locking onto said side bars and said support beams and having a means of applying power to move said side bars to more outward and inward positions along said corner leg members after said side bars have been unlocked from said corner leg members.

6. The apparatus of claim 2 further comprising threaded bores on said support beams and threaded bolts threaded through said threaded bores of said support beams facing said side bars, said bolts when rotated providing force so as to move said side bars outwardly after said side bars have been unlocked from said corner leg members.

7. The apparatus of claim 2 further comprising threaded bores on said side bars and threaded bolts threaded through said threaded bores of said side bars facing said support beams, said bolts when rotated providing force so as to move said side bars outwardly after said side bars have been unlocked from said corner leg members.

* * * * *